US009694464B2

(12) United States Patent
Lupsac

(10) Patent No.: US 9,694,464 B2
(45) Date of Patent: Jul. 4, 2017

(54) STONE POLISHING APPARATUS

(71) Applicant: Vasile Lupsac, Ottawa (CA)

(72) Inventor: Vasile Lupsac, Ottawa (CA)

( * ) Notice: Subject to any disclaimer, the term of this patent is extended or adjusted under 35 U.S.C. 154(b) by 589 days.

(21) Appl. No.: 14/195,047

(22) Filed: Mar. 3, 2014

(65) Prior Publication Data

US 2015/0246423 A1 Sep. 3, 2015

(51) Int. Cl.

| | |
|---|---|
| ***B24B 9/06*** | (2006.01) |
| ***B24B 55/02*** | (2006.01) |
| ***B24B 27/00*** | (2006.01) |
| ***B24B 23/08*** | (2006.01) |

(52) U.S. Cl.

CPC ..... *B24B 9/06* (2013.01); *B24B 23/08* (2013.01); *B24B 27/0084* (2013.01); *B24B 55/02* (2013.01)

(58) Field of Classification Search

CPC ..... B24B 9/06; B24B 23/08; B24B 27/0084; B24B 55/02

USPC ..... 451/44, 359, 439; 125/3, 25, 38

See application file for complete search history.

(56) References Cited

U.S. PATENT DOCUMENTS 1,569,194 A * 1/1926 Long ..... B24B 13/02 451/277
1,900,186 A * 3/1933 Marling ..... B24B 3/42 56/250
2,127,071 A * 8/1938 Schmalz ..... B24B 27/0084 451/146
2,603,919 A * 7/1952 Robinson ..... A47L 11/00 280/43
3,375,617 A * 4/1968 Kaufman ..... B24B 23/02 451/359
3,415,242 A * 12/1968 Nagy ..... B28D 1/045 125/13.01
3,893,372 A * 7/1975 Strakeljahn ..... B23C 3/126 144/136.95
4,175,359 A * 11/1979 Teague, Jr. ..... B24B 23/04 15/97.1
4,546,574 A * 10/1985 Blossick ..... B08B 1/04 451/354
4,922,665 A * 5/1990 Wanatowicz ..... B24D 15/026 401/137
4,934,108 A * 6/1990 Hall ..... B24B 3/38 451/358
5,028,179 A * 7/1991 Grasset ..... B23C 3/126 144/154.5
5,512,010 A * 4/1996 Labad, Jr. ..... B24D 15/023 15/105
8,162,726 B1 4/2012 Jorgensen
(Continued)

OTHER PUBLICATIONS

Double Transmission Reduction Dry Polisher R2DTRDP900, Copyright 200d, http://www.raizi.com/product_list.asp?classid=100&id=801 (accessed on Jun. 10, 2014).

*Primary Examiner* — Monica Carter
*Assistant Examiner* — Marcel Dion
(74) *Attorney, Agent, or Firm* — Eugene F. Derényi; Fogler, Rubinoff LLP

(57) ABSTRACT

An apparatus for polishing the edges and sides of granite and other stones includes a hollow rectangular base for sliding along a stone surface, a yoke mounted on the base, a disc polisher pivotally mounted in the yoke for rotation around a horizontal axis between a variety of polishing orientations, and an indexing mechanism for releasably locking the polisher in such orientations.

8 Claims, 8 Drawing Sheets

(56) References Cited

U.S. PATENT DOCUMENTS

| | | | | |
|---|---|---|---|---|
| 2001/0036802 | A1* | 11/2001 | Mueller | B24B 23/06 451/355 |
| 2004/0168681 | A1* | 9/2004 | Kalb | B23D 45/024 125/10 |
| 2006/0217044 | A1 | 9/2006 | Volponi | |
| 2008/0135033 | A1* | 6/2008 | Zagorouiko | B28D 7/00 125/4 |
| 2012/0184188 | A1* | 7/2012 | Chou | B24B 19/24 451/359 |
| 2013/0090046 | A1* | 4/2013 | Skoblenick | B24B 19/004 451/429 |

* cited by examiner 48
72
69
72
16
55
54
57
83
65
53
58
50
62
92
66
64
50
49
49
51
64
76
66
51
67
79
50
15
75
52
78
23
13
22
24
80
4
20
47
9
10
18
34
8
36
19
27
30
20
1
41
19
14
6
8
22
38
37
36
34
25
29
18
47
24
23
30
38
37
41
29
5

11
17

STONE POLISHING APPARATUS

FIELD OF THE INVENTION

This invention relates to an apparatus for polishing stone, and in particular to a manually operated apparatus for polishing the sides and edges of sheets of granite and other stones.

DESCRIPTION OF THE RELATED ART

In general, the edges and sides of granite and other stones are polished using portable disc grinders or polishers such as those sold under the Makita trademark. In order to do a good job with such devices, a great deal of time and experience is required. Another problem with the portable devices is that the power cord is usually located on the floor behind the operator where cooling water accumulates, increasing the likelihood of electrical shock and the possibility of tripping on the cord.

In the hands of an inexperienced or unskilled operator, the use of such devices often results in uneven bevelled edges. Even with an experienced tool user, holding the grinder or polisher at a certain angle for a lengthy period of time can result in muscle strain. In any event, the task of beveling edges evenly is difficult.

BRIEF SUMMARY OF THE INVENTION

The present invention provides an apparatus for polishing stone which is relatively simple and easy to manipulate, thereby preventing operator fatigue. One embodiment of the invention includes rollers for making it easy to produce an evenly polished edge on a workpiece even for an inexperienced operator. The use of a mechanism for adjusting the grinding or polishing angle relative to the workpiece facilitates the production of a smooth and even bevelled edges and sides of a workpiece.

In its simplest form, the polishing apparatus includes a base having a straight front end for sliding along the top surface of a workpiece; a handle extending outwardly from a front end of said base for manipulating the apparatus on the workpiece; a yoke on said base; a grinder pivotally mounted in the yoke for rotation around a horizontal axis parallel to the straight front end of the base; a head on said grinder extending outwardly beyond the straight front edge of the base; a grinding pad connected to a spindle extending out of said head for polishing a workpiece; and an indexing mechanism for releasably locking the grinder in one of a non-use position above the base and a plurality of use positions in which the grinding pad is perpendicular to the top surface of the workpiece for polishing a side of the workpiece or at an angle to the vertical for producing a bevelled edge on the workpiece.

BRIEF DESCRIPTION OF THE DRAWINGS

The polishing apparatus is described in greater detail below with reference to the accompanying drawings, which illustrate a preferred embodiment of the invention, and wherein.

DETAILED DESCRIPTION OF THE INVENTION

Figure 1:
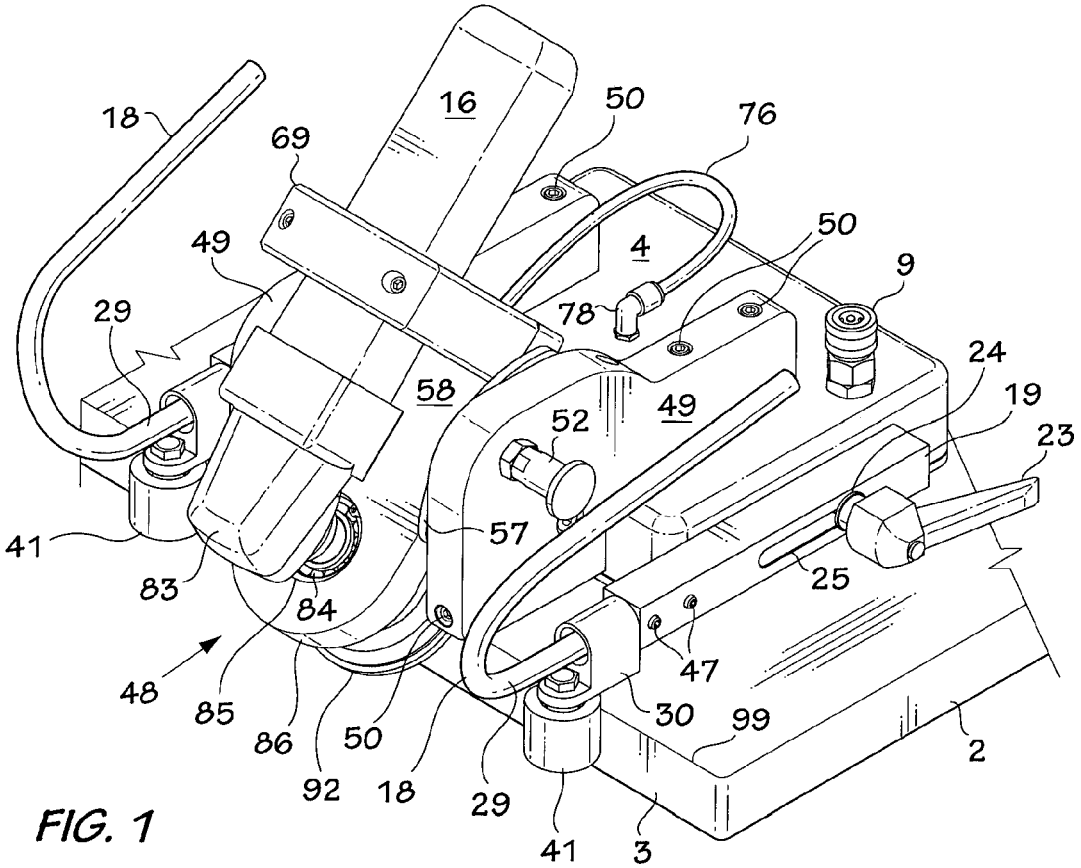
FIGS. 1 and 2 are isometric views of a polishing apparatus in accordance with the invention.
Figure 2:
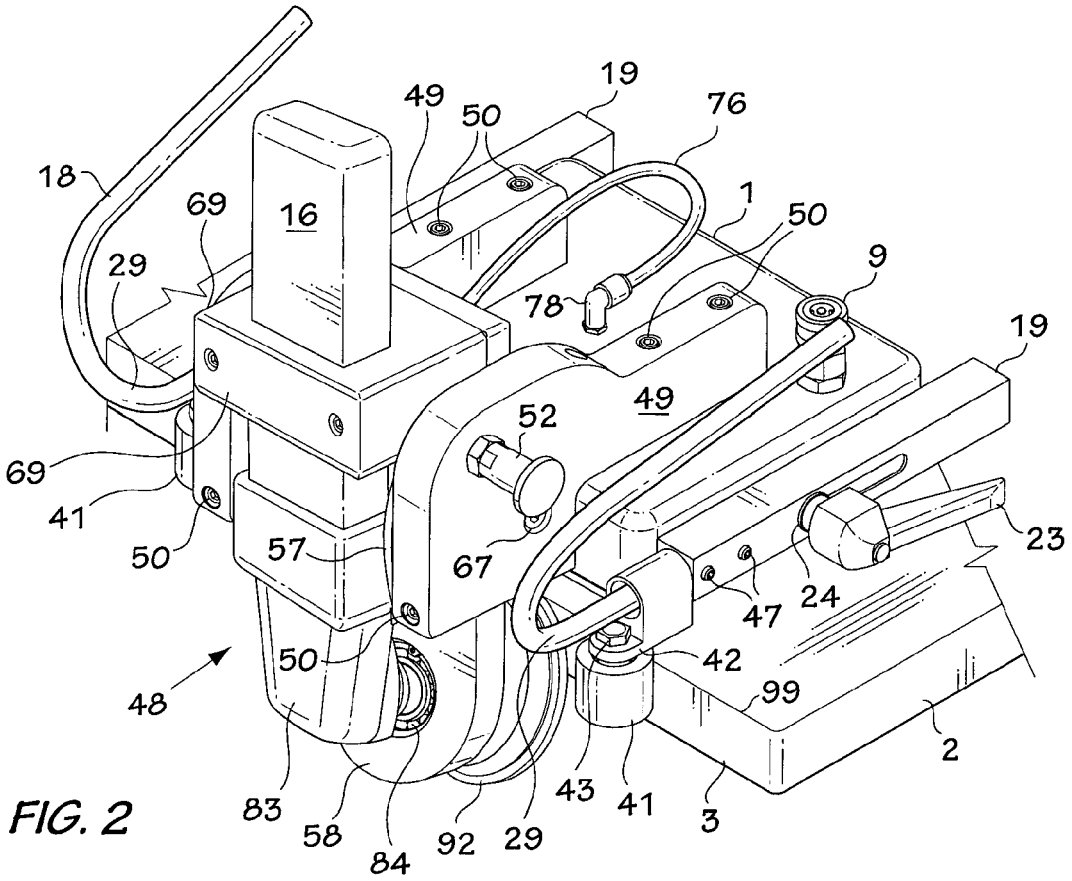
Figure 3:
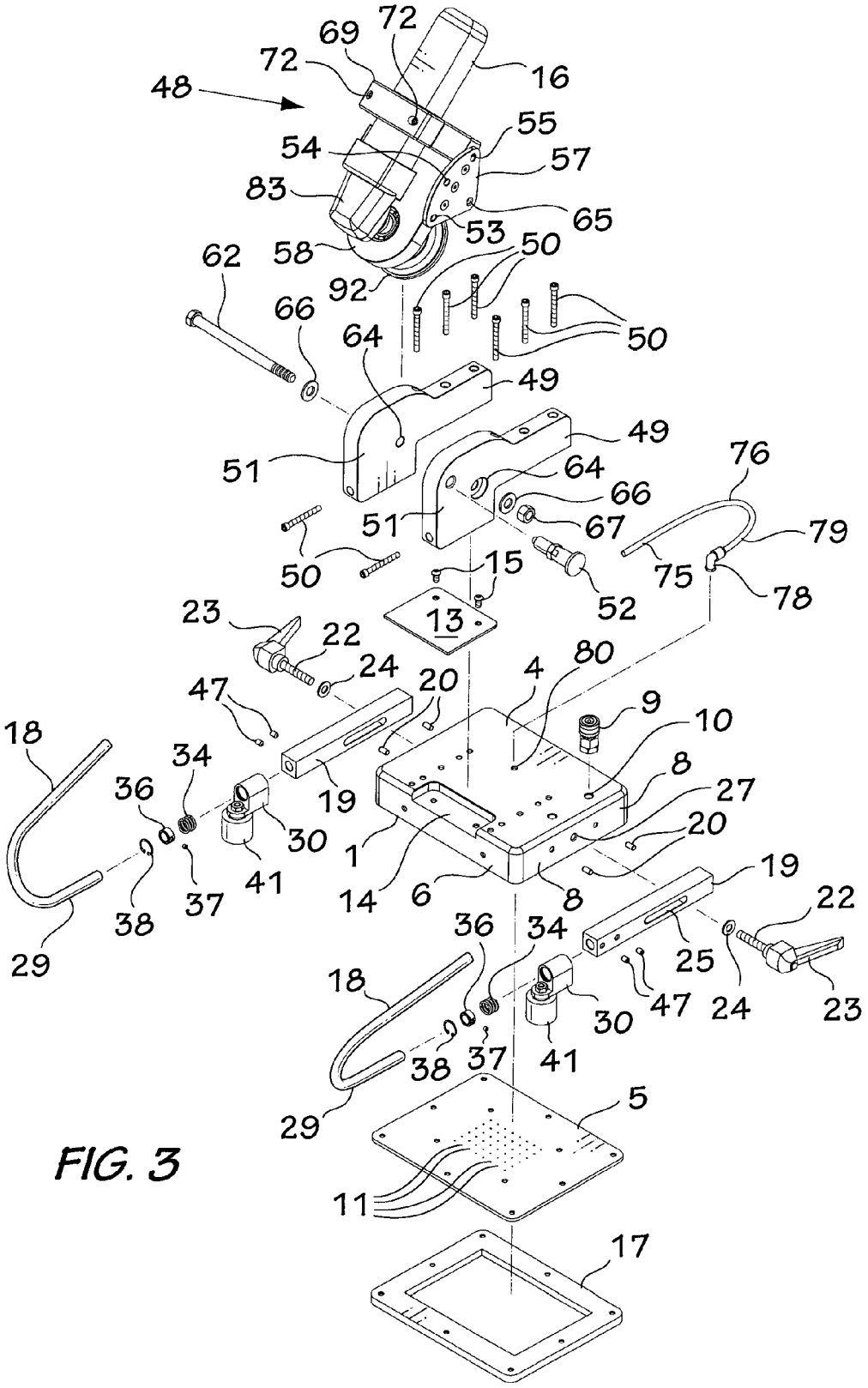
FIG. 3 is an exploded, isometric view of the polishing apparatus of FIG. 1.

With reference to FIGS. 1 to 3, the polishing apparatus includes a hollow, rectangular, steel base indicated generally at 1 for sliding along the surface of a solid workpiece 2 (FIGS. 1, 2 and 5) proximate one side 3 thereof. The base 1 includes a top wall 4, a bottom wall 5, a front wall 6, a rear wall (not shown) and side walls 8 (one shown). The base 1 acts as a reservoir for receiving water from a hose (not shown). The hose is releasably connected to the base 1 by an off-the-shelf quick connect 9 which is mounted on the top wall 4 of the base 1 above an inlet opening 10 (FIG. 3). Water is discharged from the base 1 via a plurality of small holes 11 in the bottom wall 5 of the base 1. As described hereinafter, in greater detail, stop plate 13 is secured in a shallow recess 14 in the front of the base 1 by screws 15 for limiting tilting of a disc polisher or grinder 16 relative to the base 1. A rectangular, plastic pad 17 can be connected to the bottom wall 5 of the base 1 for ensuring smooth sliding of the assembly on the workpiece 2.

A pair of handles 18 extend into two rectangular bars 19 on the side walls 8 of the base 1 for maneuvering the apparatus on the workpiece 2. The handles 18 can be generally J-shaped as shown in the drawings or straight. Moreover, both handles 18 can be replaced by a single, generally C-shaped handle (not shown) with the free ends of the handle extending into the bars 19. The bars 19 are slidable on the side walls 8 of the base 1. Each bar 19 is fixed in one position by a bolt 22 on one end of a handle 23. The bolt 22 extends through a washer 24 and a longitudinally extending slot 25 in the bar 19 into a threaded hole 27 in the side wall 8 of the base 1. When the bolts 22 are loosened, the bars 19 with the handles 18 can be moved forwardly or rearwardly relative to the base 1 to effectively make the handles longer or shorter.

Figure 4:
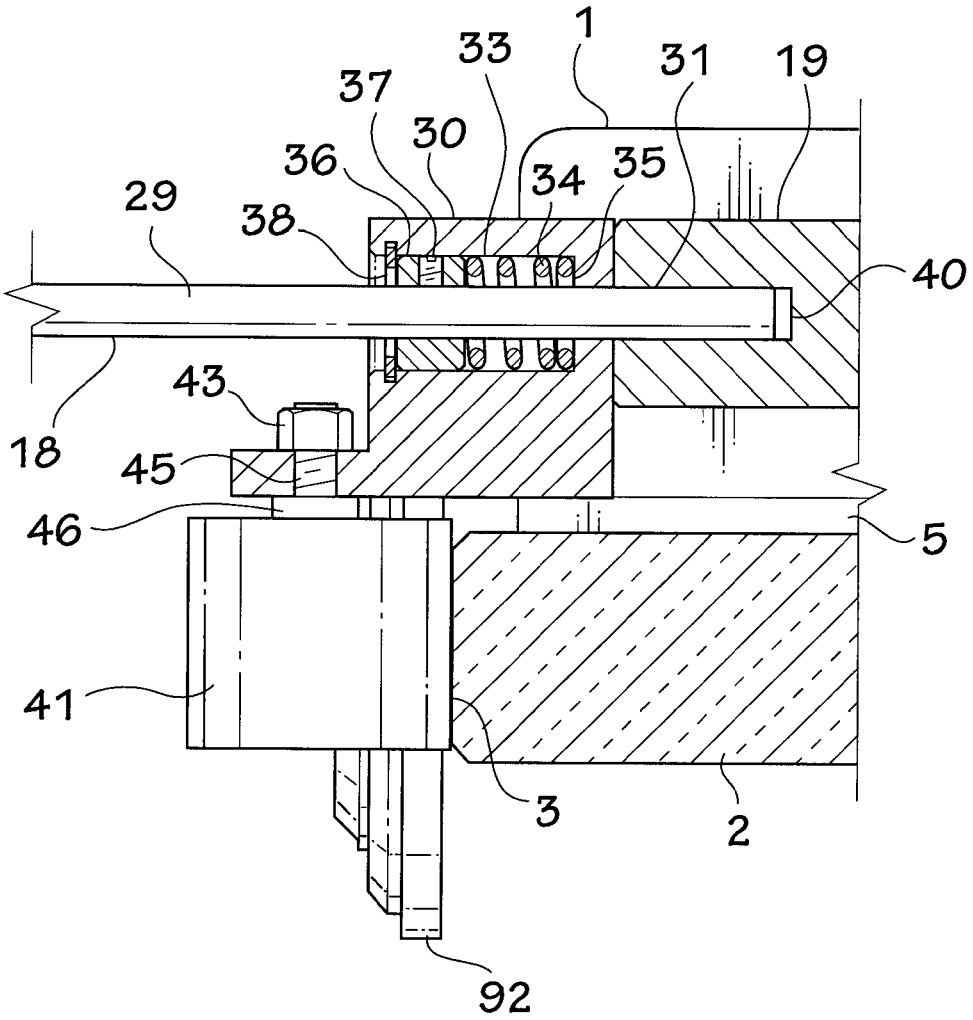
FIG. 4 is a cross-section of a portion of the front end of the polishing apparatus of FIGS. 1 to 3 with parts omitted.

As best shown in FIG. 4, one arm 29 of each handle 18 extends through a roller support 30 into a blind hole 31 in the front end of the bar 19. The front end of a handle receiving socket 33 in the roller support 30 is larger in diameter than the handle 18. A helical spring 34 around the handle 18 is sandwiched between the inner end 35 of the socket 33 and a ring 36 connected to the handle by a set screw 37. The handle 18 is held in the roller support 30 by a circlip 38 mounted in the outer end of the socket 33.

With the spring 34 in the relaxed condition shown in FIG. 4, there is a gap 40 between the inner end of the handle 18 and the inner end of the blind hole 31. Thus, the handle 18 can be pushed toward the bar 19 to compress the spring 34 and press a roller 41 against the workpiece 2. The roller 41 is suspended from a ledge 42 extending outwardly from the bottom end of the support 30 by a nut 43 connected to the threaded top end 45 of the shaft 46 of the roller. Screws 47 in the sides of the bars 19 are used to lock the handles 18 in fixed positions.

A disc polisher or grinder assembly indicated generally at 48 is pivotally mounted in a yoke defined by a pair of parallel, spaced apart plates 49 connected to the base 1 by screws 50. The plates 49 are generally L-shaped, including ends 51 extending outwardly beyond the front wall 6 of the base 1. The polishing assembly 48 is held in a fixed position by an off-the-shelf spring loaded index pin 52 extending through one plate 49 into one of three holes 53, 54 or 55 arranged in an arcuate row in a generally triangular indexing plate 57 on one side of the polishing assembly 48.

Figure 5:
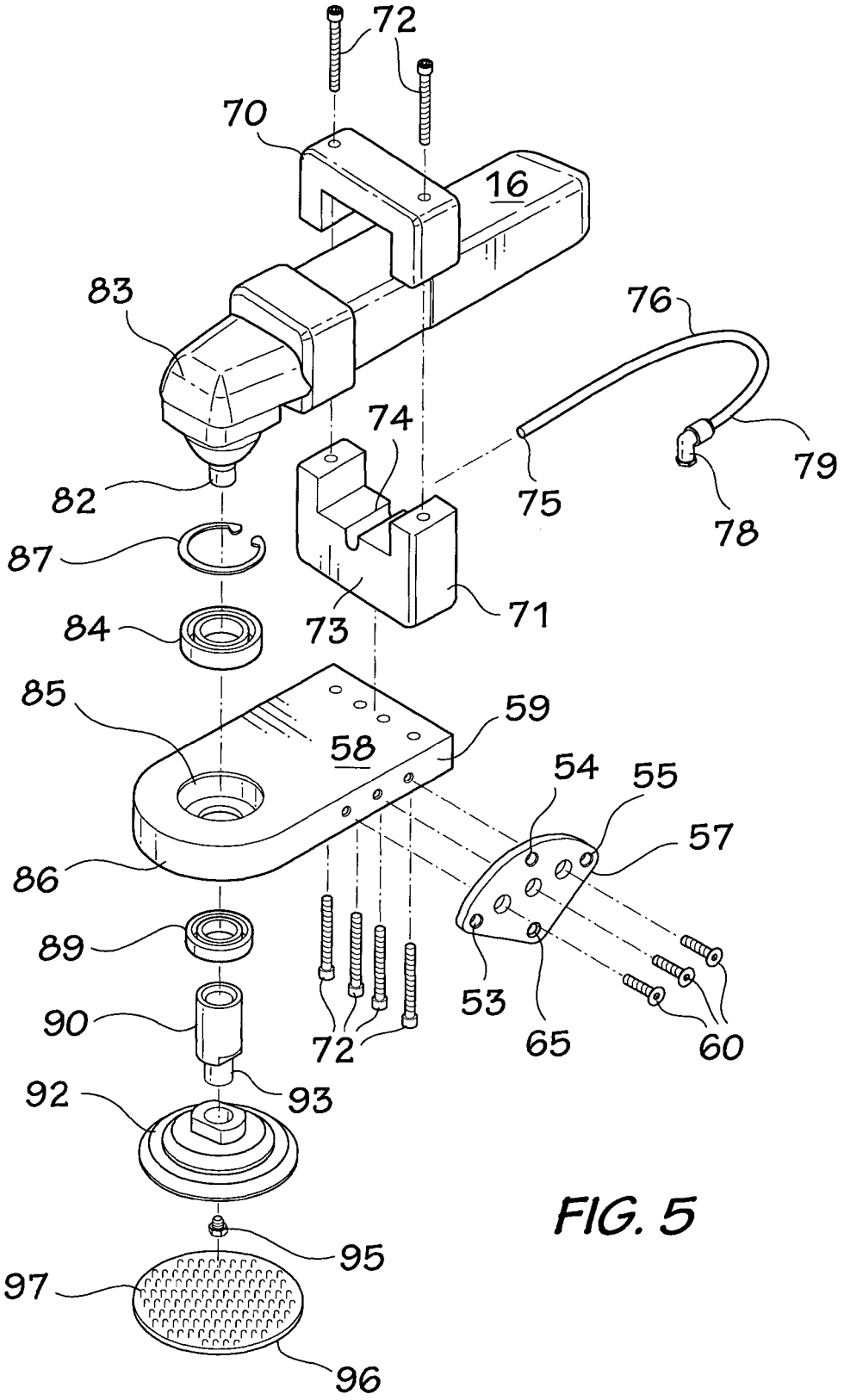
FIG. 5 is an exploded, isometric view of a polisher and bracket assembly used in the apparatus of FIGS. 1 to 3.

As best shown in FIG. 5, as well as the polisher 16, and the indexing plate 57, the polishing assembly 48 includes a generally U-shaped baseplate 58. The indexing plate 57 is mounted on one side 59 of the baseplate 58 using screws 60. The polishing assembly 48 is pivotally mounted in the yoke by a bolt 62 extending through aligned holes 64 in the plates 49 and a hole 65 near the bottom corner of the indexing plate 57, washers 66 and a nut 67. The polisher 16 is mounted on the rear end of the baseplate 58 by means of a two-piece bracket 69, which includes an inverted U-shaped top piece 70 and a U-shaped bottom piece 71 interconnected by screws 72. A notch 73 in the bight 74 of the bottom piece 71 receives one end 75 of a tube 76 which is connected to the polisher 16 for feeding water from the base 1 to the polisher 16. A coupler 78 connects the other end 79 of the tube 76 to an outlet hole 80 (FIG. 3) in the top wall 4 of the base 1, whereby some of the water entering the base 1 is fed to the polisher 16.

The spindle 82 in the head 83 of the polisher 16 extends through a bearing 84 in a countersunk hole 85 in the other end 86 of the baseplate 58. A circlip 87 holds the bearing 84 in the hole 85. A second bearing 89 is mounted in the bottom of the baseplate 58. A tubular shaft extension 90 is connected to the grinder spindle 82 and extends downwardly through the bearings 84 and 89. A rubber pad 92 is connected to the bottom end 93 of the extension 90 using a threaded nozzle 95. During grinder operation, water from the base 1 is fed through the tube 76 to the polisher head. The water enters the spindle 82 and passes downwardly through the extension 90 and the nozzle 95 to the workpiece 2. A polishing disc 96 is mounted on the bottom of the pad 92 using a hook and loop connection (not shown) of the type employed on off-the-shelf disc polishers, i.e. VELCRO7 hooks are provided on the bottom of the pad 92 for mating with loops 97 on the top of the disc 96 or vise versa.

Referring again to FIGS. 1 to 3, with the index pin 52 in the hole 53 in the indexing plate 57 the polisher 16 is located in a slightly tilted, non-use position (not shown) above the base 1. In the non-use condition of the assembly, the bars 19 extend beyond the rear end of the base 1 (see FIG. 2). In these positions of the polisher 16 and the bars 19, the center of gravity of the assembly is rearward of the front of the base 1, making carrying of the assembly less awkward. In order to polish a top edge 99 (FIG. 1) of the workpiece 2, the bars 19 are moved forward to the positions shown in FIG. 1. By pulling the index pin 52 outwardly, the polisher assembly 48 can be rotated around the longitudinal axis of the bolt 62. During rotation, the index pin 52 is released and ends up in the hole 54, locking the polisher assembly 48 in the position shown in FIG. 1 for polishing the top edge 99 of the workpiece 2. The handles 18 are pushed towards the workpiece 2 to bias the rollers 41 against the workpiece 2, causing the disc 96 to engage the workpiece 2. The assembly is moved along the side of the workpiece 2 to polish the top edge 99. When the handles 18 are released the springs 34 push the handles 18 and the rollers 41 away from the workpiece 2.

In order to polish the side 3 of the workpiece 2, the bars 19 are moved rearwardly to the positions shown in FIG. 2, the index pin 52 is retracted and the polisher assembly 48 is rotated to the position shown in FIGS. 2 and 4 which causes the pin to enter the hole 55 in the indexing plate 57. The polisher assembly is prevented from going beyond the vertical position shown in FIG. 2 by the stop plate 13 (FIG. 3). The handles 18 are pushed inwardly and the assembly is moved along the side of the workpiece 2 as described above.

Figure 6:
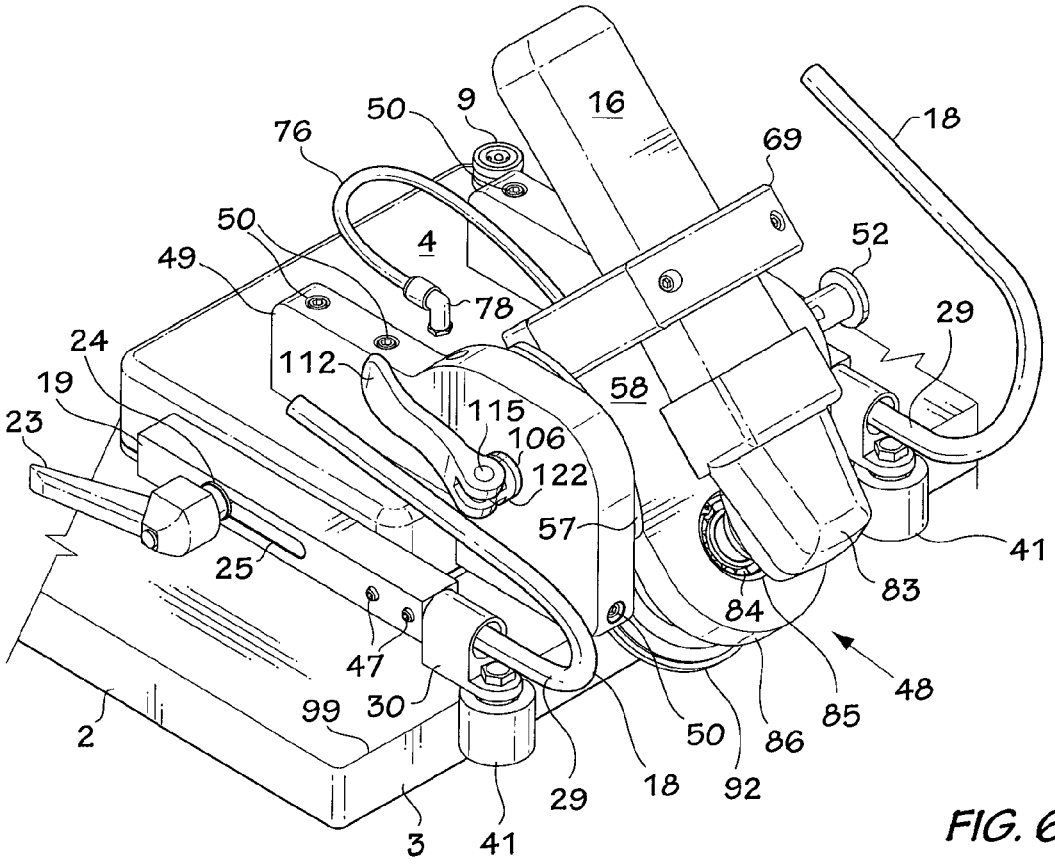
FIG. 6 is an isometric view of a second embodiment of the polishing apparatus.
Figure 7:
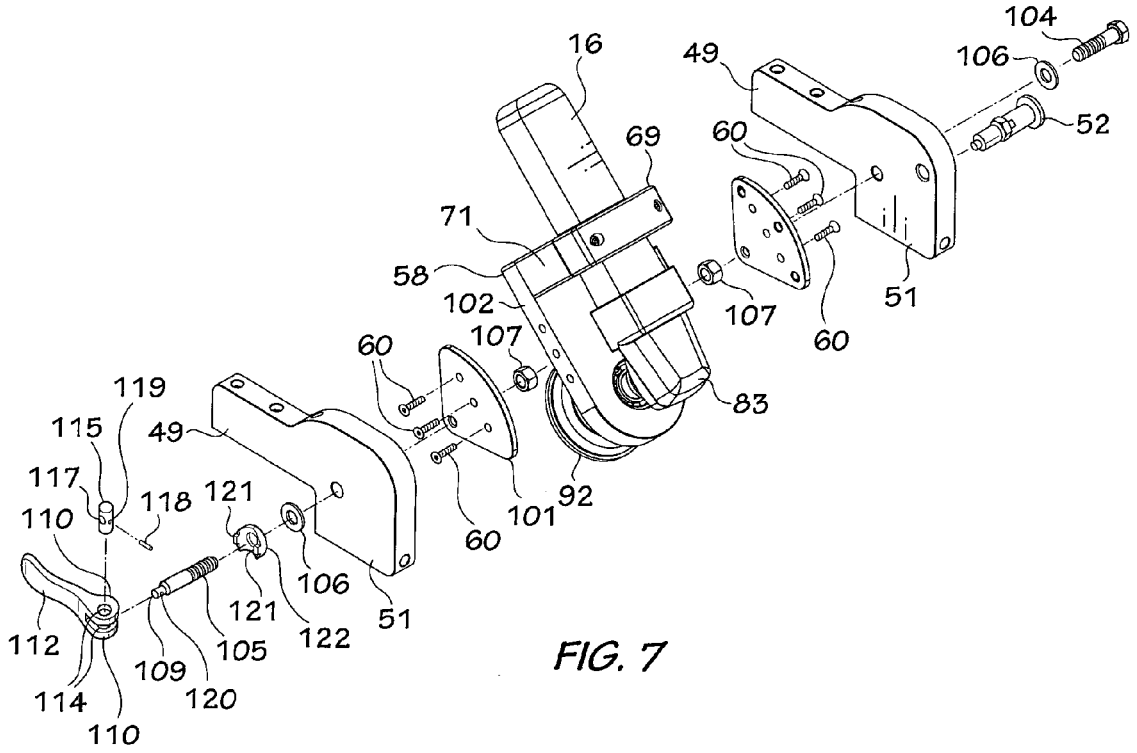
FIG. 7 is an exploded, isometric view of the apparatus of FIG. 6.
Figure 8:
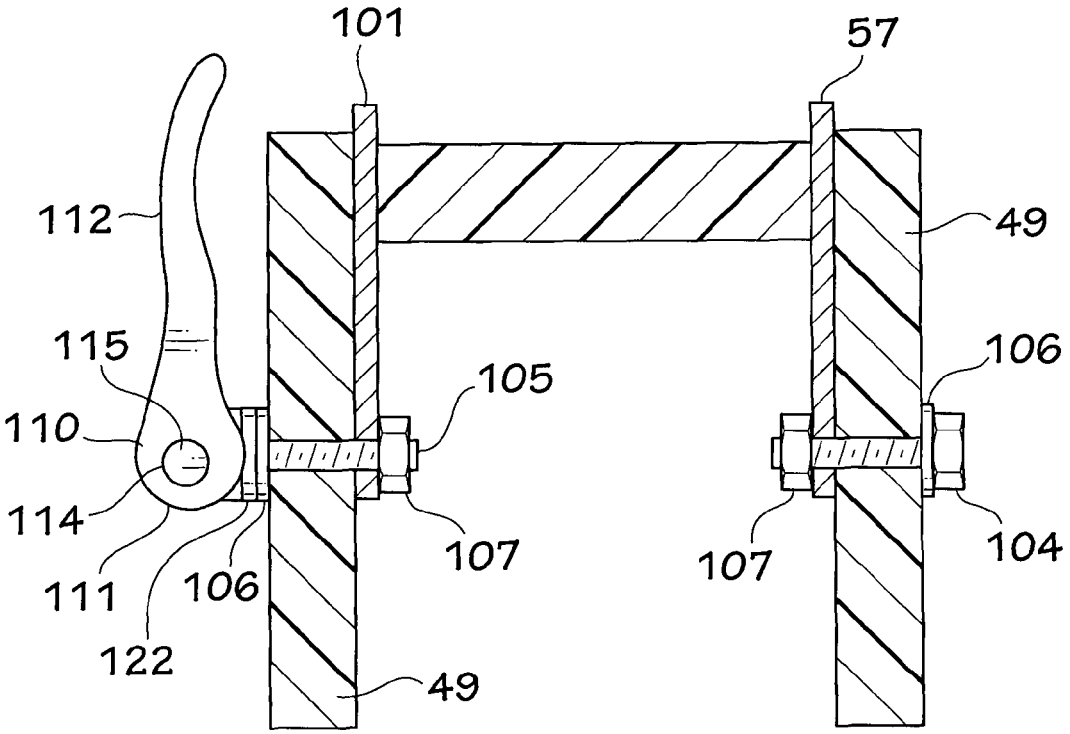
FIG. 8 is a cross-section of a portion of the front end of the apparatus of FIGS. 6 and 7.

A second embodiment of the invention is illustrated in FIGS. 6 to 8, in which the same reference numbers are used to identify the elements the same or similar to those in FIGS. 1 to 5.

In the second embodiment of the invention, a second indexing plate 101 is connected to a second side 102 of the base plate 58 using screws 60 (FIG. 8). The bolt 62 (FIG. 3), the washers 66 and the nut 67 are replaced by a pair of bolts 104 and 105, washers 106 and nuts 107. The bolts 104 and 105 extend through the sides 49 of the yoke and the indexing plates 57 and 101 for pivotally mounting the grinder assembly 48 in the yoke.

Referring to FIGS. 6 and 7, the bolt 105 has a reduced diameter outer end 109 for insertion between the arms 110 of the bifurcated end 111 (FIG. 8) of a cam lever 112. The arms 110 are generally circular and include off-centered holes 114 for receiving a small shaft 115. The reduced diameter outer end 109 of the bolt 105 is inserted into a diametrically extending hole 117 in the shaft 115, and a pin 118 is inserted through a radially extending hole 119 at 90° to the hole 117 into a diametrically extending hole 120 in the end 109 of the bolt 105. The arms 110 at the end 111 of the lever straddle a pair of ears 121 on a pivot plate 122 sandwiched between the lever end 111 and the washer 106.

The end 111 of the lever 112 acts as a cam. In the position shown in FIG. 8, the lever 112 exerts pressure on the plate 122 and the washer 106, drawing the nut 107 tight against the indexing plate 101 to prevent rotation of the latter and consequently rotation of the polishing assembly 48. When the lever 112 is rotated by 90° to a position in which it is more or less aligned with the bolt 105, the indexing plate 101 is released and consequently, when the index pin 52 is retracted, the polisher assembly 48 is free to rotate to any of a plurality of use positions. Thus, the angle of the beveled edge on the workpiece can be virtually infinitely varied. Once the desired tilt of the polishing assembly 48 has been achieved, the lever 112 is again rotated to the position shown in FIG. 8.

The invention claimed is:

1. An apparatus for polishing stone comprising a base having a straight front end and side walls for sliding along the top surface of a workpiece; a bar slidable on each of the side walls; a handle extending outwardly from the front end of each of said bars proximate the straight front end of said base for manipulating the apparatus on the workpiece; a yoke on said base; a grinder pivotally mounted in the yoke for rotation around a horizontal axis parallel to the straight front end of the base; a head on said grinder extending outwardly beyond the straight front edge of the base; a grinding pad connected to a spindle extending out of said head for polishing a workpiece; and an indexing mechanism for releasably locking the grinder in one of a non-use position above the base and a plurality of use positions in which the grinding pad is perpendicular to the top surface of the workpiece for polishing a side of the workpiece or at an angle to the vertical for producing a bevelled edge on the workpiece, including a roller extending downwardly from the front end of each said bar for gliding along the side of the workpiece to accurately orient the grinding pad with respect to the edge or side of the workpiece.

2. The polishing apparatus of claim 1, wherein said indexing mechanism includes an indexing plate connected to one side of said polisher; an arcuate row of holes in said indexing plate; and an index pin extending through one side of said yoke into one of said holes, whereby the pin can be retracted, the polisher rotated from one of said non-use or use positions to another of said positions and the pin released to enter another of said holes.

3. The polishing apparatus of claim 2, including a roller holder on said handle at the front end of said bar; a spring on said handle in said holder biasing said handle outwardly; and a ring on the handle in the holder for compressing the spring and biasing the roller against the side of the workpiece during movement of the base along the workpiece.

4. The polishing apparatus of claim 1, wherein said indexing mechanism includes a first indexing plate connected to one side of said polisher; an arcuate row of holes in said indexing plate; and an index pin extending through one side of said yoke into one of said holes, whereby the pin can be retracted, the polisher rotated from one of said non-use or use positions to another of said positions and the pin released to enter another of said holes.

5. The polish apparatus of claim 4 including a second indexing plate connected to a second side of said polisher, and a cam lever for releasably locking said polisher in any of a plurality of use positions.

6. The polishing apparatus of claim 1, wherein said base is hollow for receiving water from a source thereof, the base including a bottom wall; and a plurality of holes in the bottom wall for discharging the water against the workpiece.

7. The polishing apparatus of claim 6 including a top wall on said base; an inlet in the top wall; a quick connect for connecting the inlet to the source of water; an outlet in said top wall; and a hose connecting said outlet to the grinder for feeding cooling water to the grinder.

8. The polishing apparatus of claim 1, where the said handles comprise a handle with the free ends of the handle extending into the said bars.

* * * * *